US011141998B2

(12) United States Patent
Ban et al.

(10) Patent No.: US 11,141,998 B2
(45) Date of Patent: Oct. 12, 2021

(54) PRINTING APPARATUS

(71) Applicant: SEIKO EPSON CORPORATION, Tokyo (JP)

(72) Inventors: Ryosuke Ban, Shiojiri (JP); Daisuke Hiruma, Matsumoto (JP); Kiyoto Komuro, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/002,294

(22) Filed: Aug. 25, 2020

(65) Prior Publication Data

US 2021/0060984 A1 Mar. 4, 2021

(30) Foreign Application Priority Data

Aug. 28, 2019 (JP) ..... JP2019-155524

(51) Int. Cl.
*B41J 13/02* (2006.01)
*B41J 13/03* (2006.01)
*B41J 11/14* (2006.01)

(52) U.S. Cl.
CPC ..... *B41J 11/14* (2013.01); *B41J 13/02* (2013.01); *B41J 13/03* (2013.01)

(58) Field of Classification Search
CPC . B41J 13/02; B41J 13/025; B41J 13/03; B41J 11/14; B41J 15/04; B41J 15/16; B65H 20/02; B65H 20/00
See application file for complete search history.

(56) References Cited

U.S. PATENT DOCUMENTS

2017/0087899 A1* 3/2017 Aoki ..... B41J 15/04

FOREIGN PATENT DOCUMENTS

JP 2017-065893 A 4/2017

* cited by examiner

*Primary Examiner* — Huan H Tran
(74) *Attorney, Agent, or Firm* — Workman Nydegger

(57) ABSTRACT

A printing apparatus includes a printing unit configured to perform printing onto a printing medium, a driving roller configured to provide a transporting force to the printing medium, a plurality of driven rollers configured to press the printing medium, which is transported by the driving roller, and configured to rotate in conjunction with a movement of the printing medium, a plurality of support members each being configured to support a roller shaft serving as a rotation axis about which each of the plurality of driven rollers rotates, a base body to which the plurality of support members are attached, and an attachment/removal mechanism configured to cause the plurality of support members to be removably attachable individually to the base body.

4 Claims, 8 Drawing Sheets

PRINTING APPARATUS

The present application is based on, and claims priority from JP Application Serial Number 2019-155524, filed Aug. 28, 2019, the disclosure of which is hereby incorporated by reference herein in its entirety.

BACKGROUND

1. Technical Field

The present disclosure relates to a printing apparatus including a roller for transporting a printing medium.

2. Related Art

There is described, in JP 2017-65893 A, a printing apparatus including a printing unit configured to perform printing on a printing medium, a driving roller configured to transport the printing medium to the printing unit, and a driven roller rotatably supported by a roller shaft and configured to rotate about the roller shaft while pressing the printing medium being transported against the driving roller, and a shaft support body including a shaft support portion on which the roller shaft is supported. The printing apparatus includes the shaft support body formed by one piece of member, where in the shaft support portion, the roller shaft is removably supported with respect to the shaft support body.

In the printing apparatus described in JP 2017-65893 A, the driven roller that is worn and damaged can be replaced by removing the roller shaft from the shaft support body, however, there is an issue in that the shaft support body cannot be readily replaced when the shaft support body including the shaft support portion on which the roller shaft is supported is damaged.

SUMMARY

A printing apparatus of the present application includes a printing unit configured to perform printing on a printing medium, a driving roller configured to provide a transporting force to the printing medium, a plurality of driven rollers configured to press the printing medium, which is transported by the driving roller, and configured to rotate in conjunction with a movement of the printing medium, a plurality of support members each being configured to support a roller shaft serving as a rotation axis about which each of the plurality of driven rollers rotates, a base body to which the plurality of support members are attached, and an attachment/removal mechanism configured to cause the plurality of support members to be removably attachable individually to the base body.

DESCRIPTION OF EXEMPLARY EMBODIMENTS

1. Embodiment 1

Figure 1:
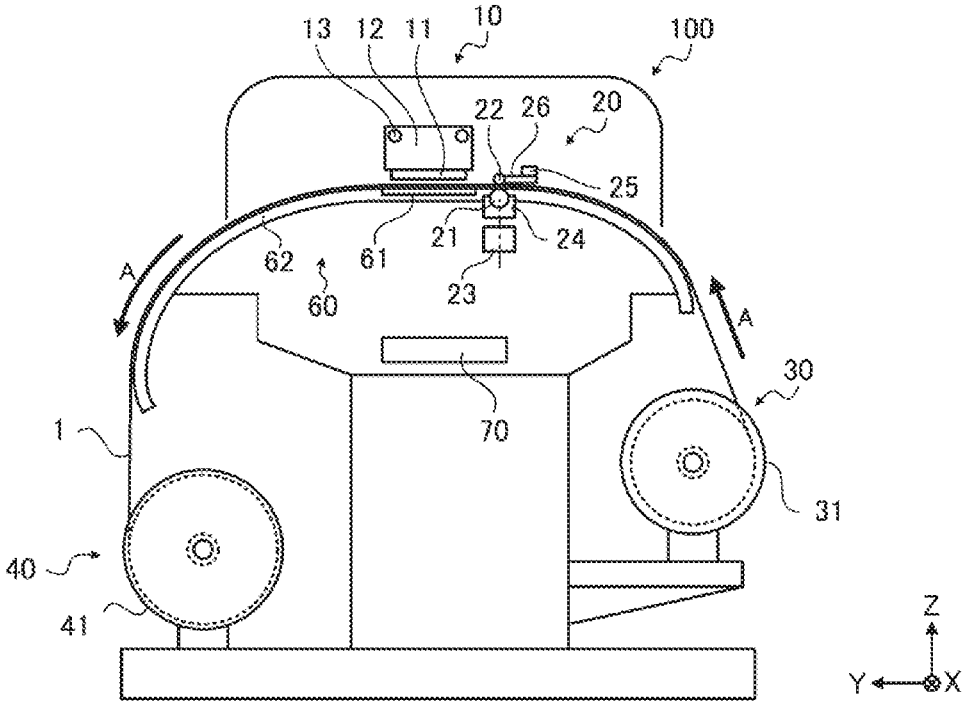
FIG. 1 is a side view schematically illustrating a configuration of a printing apparatus according to Embodiment 1.
Figure 2:
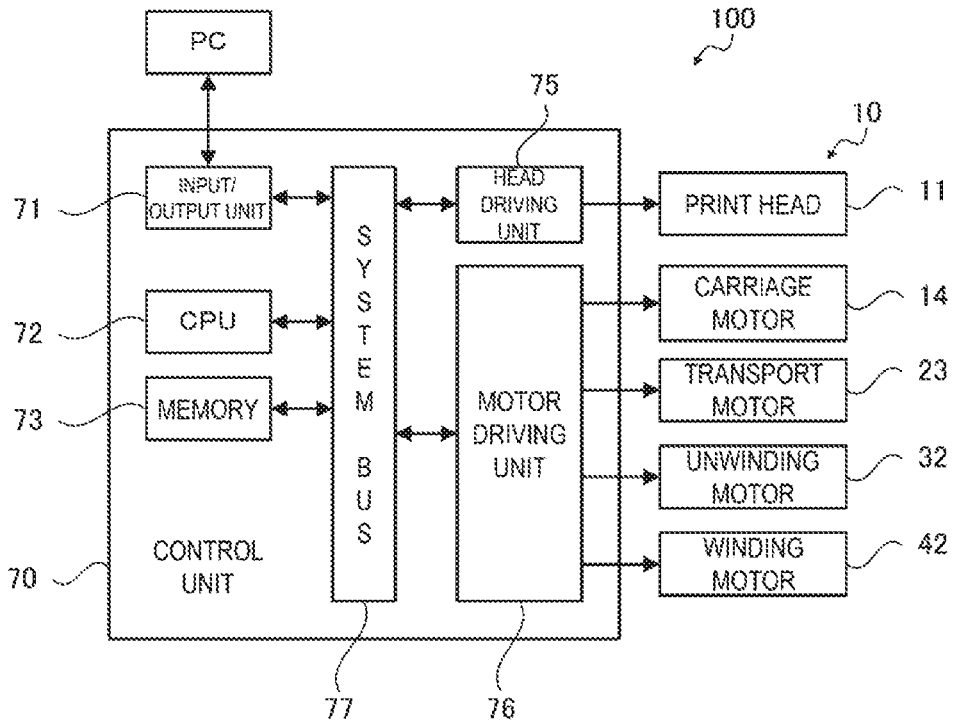
FIG. 2 is a block diagram illustrating a configuration of a printing apparatus according to Embodiment 1.

FIG. 1 is a side view schematically illustrating a configuration of a printing apparatus 100 according to Embodiment 1. Further, FIG. 2 is a block diagram of the printing apparatus 100.

As for coordinates appended in the drawings, it is assumed that a Z-axis direction is an up/down direction, a Z direction is an upward direction, a Y-axis direction is a front/rear direction, a +Y direction is a frontward direction, an X-axis direction is a left/right direction, a +X direction is a leftward direction, and an X-Y plane is a horizontal plane.

The printing apparatus 100 serves as an ink jet-type printer configured to print an image on a printing medium 1 in an elongated form supplied in a state of being wound in a rolled form.

The printing apparatus 100 includes a printing unit 10, a transport unit 20, an unwinding unit 30, a winding unit 40, a transport support unit 60, a control unit 70, and the like.

The printing unit 10 includes a print head 11, a carriage 12, a guide shaft 13, and a carriage motor 14. The print head 11 serves as an ink jet head provided with a plurality of nozzles for discharging ink. The plurality of nozzles are aligned in the Y-axis direction to constitute one nozzle row. The guide shaft 13 extends in a width direction of the printing medium 1, which intersects a transport direction A in which the printing medium 1 is transported. The transport direction A coincides with a direction in which the printing medium 1 moves on a transport path on which the printing medium 1 is transported from the unwinding unit 30 through the printing unit 10 to the winding unit 40. In the following description, the width direction of the printing medium 1 coincides with the X-axis direction, and a direction in which the printing medium 1 is transported in a print region in which the printing unit 10 performs printing coincides with the Y-axis direction.

The print head 11 is mounted on the carriage 12, and the carriage motor 14 driven and controlled by the control unit 70 causes the carriage 12 to reciprocatively move along the guide shaft 13.

The control unit 70 is configured to print a desired image on the printing medium 1 by alternately repeating a discharge operation of discharging ink droplets from the print head 11 while causing the carriage 12 to move in the X-axis direction, and a transport operation of causing the transport unit 20 to move the printing medium 1 in the transport direction A.

Note that the printing unit 10 is configured by a serial head that reciprocatively moves in the X-axis direction as described above, and may be configured by a line head in which the nozzles are aligned across a width of the printing medium 1 in a direction intersecting the transport direction A. Moreover, the printing apparatus 100 may be a printing apparatus including a printing unit other than a so-called ink jet-type print head such as that described above.

The transport unit 20, which serves as a transport mechanism configured to provide a transporting force to the printing medium 1 to transport the printing medium 1, is provided upstream of the printing unit 10 in the transport direction A. The transport unit 20 includes a driving roller 21, a driven roller 22, a transport motor 23, a support stage 24, a pressing force setting unit 25, a support member 26, and the like.

The driving roller 21 is configured to perform driving in a state of clamping the printing medium 1 between the driving roller 21 and the driven roller 22, to thus provide the transporting force to the printing medium 1 to transport the printing medium 1.

The pressing force setting unit 25 is configured to set a pressing force from the driven roller 22 that is necessary when the driven roller 22 and the driving roller 21 clamp the printing medium 1 in between.

The unwinding unit 30, which serves as a housing unit for housing the printing medium 1 before performing printing, is located upstream of the printing unit 10 and the transport unit 20 in the transport direction A, and includes an unwinding reel 31 and the like. The unwinding reel 31 is rotated by an unwinding motor 32 driven and controlled by the control unit 70 to unwind the printing medium 1 toward the printing unit 10 and the transport unit 20 that are arranged downstream of the unwinding unit 30.

The winding unit 40, which serves as a collection unit for unwinding the printing medium 1 transported from the printing unit 10 and collecting the printing medium 1 in a state of being wound in a rolled form, is located downstream of the printing unit 10 in the transport direction A in which the printing medium 1 is transported and includes a winding reel 41 and the like.

The winding reel 41 includes a rotation shaft rotated by a winding motor 42 driven and controlled by the control unit 70, and winds the printing medium 1 fed through the print region of the printing unit 10 about the rotation shaft being an axial center.

The transport support unit 60 includes a platen 61 for supporting the printing medium 1 while facing a print head 11, a medium support unit 62 constituting a transport path for transporting the printing medium 1 from the unwinding unit 30 through the printing unit 10 to the winding unit 40, and the like. The region in which a printing is performed on the printing medium 1 supported by the platen 61 coincides with the print region. That is, the platen 61 at least supports a portion facing the print head 11 in the print region. Note that the platen 61 is provided downstream of both the driven roller 22 and the driving roller 21 in the transport direction A.

The printing medium 1, which is unwound from the unwinding unit 30, passes through the printing unit 10 by the transport support unit 60 in conjunction with a printing operation, and is wound by the winding unit 40.

As illustrated in FIG. 2, the control unit 70 includes an input/output unit 71, a CPU 72, a memory 73, a head driving unit 75, a motor driving unit 76, a system bus 77, and the like, and performs centralized control over the entirety of the printing apparatus 100.

The input/output unit 71 is configured to communicate data between an external device PC such as a personal computer and the printing apparatus 100, for example.

The CPU 72, which is an arithmetic processing device for controlling over the entirety of the printing apparatus 100, is coupled to the input/output unit 71, the memory 73, the head driving unit 75, and the motor driving unit 76 via the system bus 77.

The memory 73, which is a region for storing a program run by the CPU 72 and for recording necessary information, is constituted by storage elements such as a RAM, a ROM, and a flash memory.

The CPU 72 is configured to control the head driving unit 75 and the motor driving unit 76 in accordance with a program stored in the memory 73 and a printing command received from the external device.

The term CPU is an abbreviation for Central Processing Unit, the RAM is an abbreviation for Random Access Memory, and the ROM is an abbreviation for Read-Only Memory. The CPU 72 may be constituted only by one piece of CPU, or may be constituted by a plurality of CPUs, and each of the plurality of CPUs is coupled with the head driving unit 75 and the motor driving unit 76.

Figure 3:
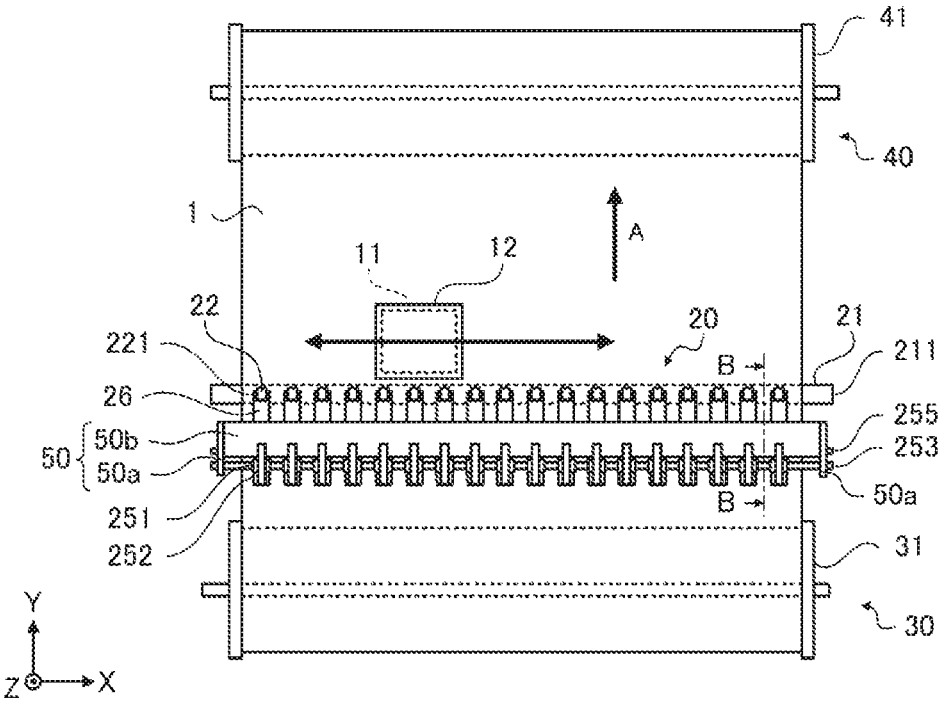
FIG. 3 is a plan view illustrating configurations of a main portion and a peripheral portion of a transport unit.
Figure 4:
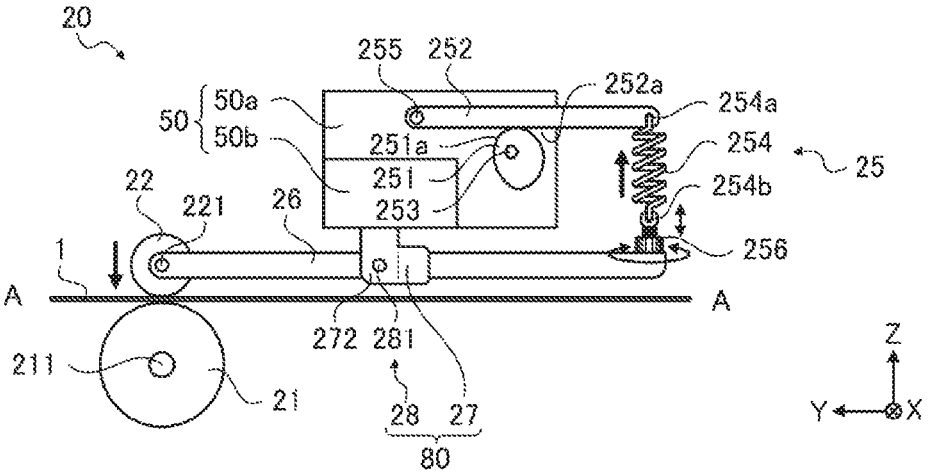
FIG. 4 is a side view illustrating a configuration of a main portion of a transport unit.

FIG. 3 is a plan view illustrating configurations of a main portion and a peripheral portion of the transport unit 20. Further, FIG. 4 is a side view illustrating a configuration of the main portion of the transport unit 20. FIG. 4 illustrates a side face when viewed in the B-B plane of FIG. 3.

As illustrated in FIG. 3, the driving roller 21 is one piece of roller having a length greater than a width of the printing medium 1 having the maximum width used in the printing apparatus 100. The driving roller 21, which includes a rotation shaft 211 extending in the X-axis direction supported by the support stage 24, is driven by the transport motor 23 driven and controlled by the control unit 70. The support stage 24, the control unit 70, and the transport motor 23 are illustrated in FIG. 1.

A plurality of the driven rollers 22 press the printing medium 1 against the driving roller 21 and are supported by a plurality of the support members 26. The plurality of the driven rollers 22 are provided side by side in the X-axis direction. Each of the driven rollers 22 includes a rotation shaft 221 as a roller shaft extending in the X-axis direction and supported by the support member 26, and presses the printing medium 1 against the driving roller 21. Each of the driven roller 22 rotates in conjunction with a movement of the printing medium 1.

The plurality of the support members 26 are provided side by side in the X-axis direction while being supported by a base body 50, where one piece of the support member 26 rotatably supports one piece of the driven roller 22.

More specifically, the support member 26, which is a member composed of a resin extending in the Y-axis direction when attached to the base body 50, individually supports the rotation shaft 221 of each of the driven rollers 22 at an end portion in the +Y direction. The support member 26 is coupled with the pressing force setting unit 25 individually provided for setting the pressing force from the driven roller 22 at the end portion in a −Y direction. The support member 26, which also includes, in a direction in which the support member 26 extends, that is, at the center portion in the longitudinal direction, a pair of support shafts 281 protruding in a direction that coincides with an axial direction in which the rotation shaft 221 extends, is individually and removably attached to a support frame 50*b* via an attachment/removal mechanism 80 including the support shaft 281.

The base body 50 is constituted by a pair of support plates 50*a* and the support frame 50*b*.

The pair of support plates 50*a* are provided at both of outer sides in the X-axis direction of the transport path of the printing medium 1, and supports the support frame 50*b* and a cambar rotation shaft 255 that will be described later, and a cam rotation shaft 253.

The support frame 50*b*, which includes a square bar-like metal frame having a length greater than the width of the printing medium 1 having the maximum width used in the printing apparatus 100, is supported at the both end portions by the support plate 50*a* so as to be installed in the X-axis direction.

Note that the transport support unit 60, the support stage 24, and the support plate 50*a* are fixedly supported on a main frame for constituting the printing apparatus 100 as a single apparatus. An illustration of the main frame is omitted.

Figure 5:
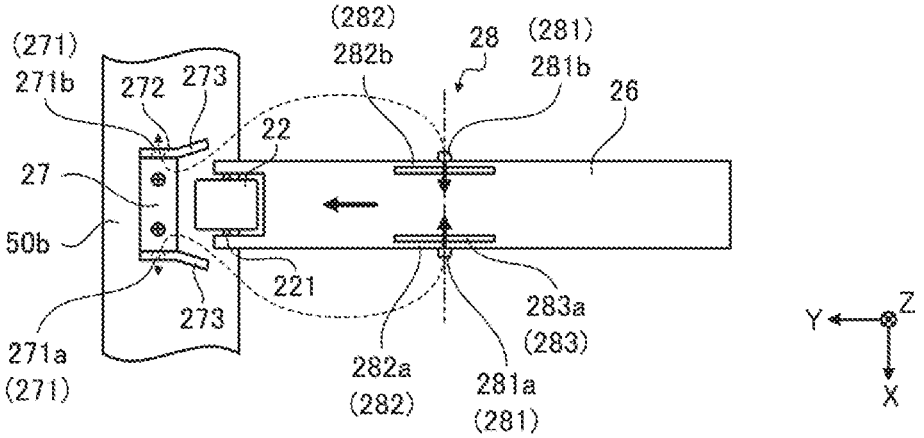
FIG. 5 is a plan view illustrating a configuration of an attachment/removal mechanism.

FIG. 5 is a plan view illustrating a configuration of the attachment/removal mechanism 80. FIG. 5 illustrates a state of the support frame 50*b*, and the support member 26 before being attached to the support frame 50*b* when viewed in a −Z direction.

The attachment/removal mechanism 80 is constituted by a fitting metal 27 constituting a base portion provided at the base body 50, and a fitting portion 28 provided at the support member 26.

The fitting portion 28 includes the pair of support shafts 281, and a pair of elastic members 282 for supporting the support shafts 281, respectively, and the fitting metal 27 includes two pieces of bearings 272 each having a fitting hole 271 into which each of the pair of support shafts 281 fits.

A one support shaft 281*a* of the pair of support shafts 281 is provided in a manner protruding in the +X direction being parallel to an axial direction of the rotation shaft 221 at a center portion of the support member 26 in the direction in which the support member 26 extends. Another support shaft 281*b* of the pair of support shafts 281 is provided to protrude in the −X direction being parallel to the axial direction of the rotation shaft 221 at the center portion of the support member 26 in the direction in which the support member 26 extends.

Each of the pair of elastic members 282 is configured as a resin beam supported by the support member 26 composed of a resin having elasticity by a slit 283 provided at center portions of both side faces of the support member 26 in the direction in which the support member 26 extends.

Further, the support shaft 281, which is integrally molded with the elastic member 282, is formed in a manner protruding from a center portion of the elastic member 282 toward an outer side in a width direction of the support member 26. Specifically, the one support shaft 281*a* of the pair of support shafts 281 is integrally molded with a one elastic member 282*a* of the pair of elastic members 282. Similarly, the other support shaft 281*b* of the pair of support shafts 281 is integrally molded with another elastic member 282*b* of the pair of elastic members 282. Each of the pair of support shafts 281 is provided to be displaceable, by the elastic member 282 supporting each of the support shafts 281, in the +X direction or the −X direction being parallel to the axial direction in which the rotation shaft 221 extends.

The fitting metal 27 includes a pair of the bearings 272 and a pair of trigger plates 273. The fitting metal 27 is fixed by being screwed into the support frame 50*b*, in a state where the pair of support shafts 281 each fit into each of the two fitting holes 271, such that an axial direction in which the pair of support shafts 281 extends becomes parallel to the X-axis direction. In other words, the fitting metal 27 is fixed by being screwed into the support frame 50*b* such that a direction in which the two pieces of the fitting holes 271 are aligned becomes parallel to the X-axis direction.

The trigger plate 273, which includes a sheet metal for facilitating an insertion of the support shaft 281 into the fitting hole 271 included in the bearing 272, is configured such that a spacing between the two pieces of the bearings 272 in the −Y direction gradually widened relative to the spacing in the X-axis direction.

It is preferred that the fitting metal 27 contain a material having rigidity (for example, bending rigidity or torsional rigidity) that is higher than the material constituting the support member 26. This makes it possible to enhance the mechanical strength when the fitting metal 27 supports the support member 26.

When attaching the support member 26 to the fitting metal 27 or to the support frame 50*b*, that is, to the base body 50, the pair of elastic members 282 are pressed such that the one support shaft 281*a* of the pair of support shafts 281 is displaced in the −X direction and the other support shaft 281*b* of the pair of support shafts 281 is displaced in the +X direction. This allows a width between both ends of the pair of support shafts 281 to become less than a spacing between inner walls of the pair of the bearings 272 facing each other in the X-axis direction. In this state, the pressing is released from the elastic member 282 while causing the pair of support shafts 281 to fit into the corresponding fitting holes 271. An elastic force of the pair of elastic members 282 in the X-axis direction holds a fitting state where the support shaft 281 fits into the bearing 272. That is, the one support shaft 281*a* of the pair of support shafts 281 is caused to fit into a one fitting hole 271*a* of a pair of the fitting holes 271. Similarly, the other support shaft 281*b* of the pair of support shafts 281 is caused to fit into another fitting hole 271*b* of the pair of the fitting holes 271.

As a more simple and convenient fitting method, the support member 26 may be attached by causing the support member 26 to move in the +Y direction such that the both ends of the pair of support shafts 281 enter between the pair of trigger plates 273, as illustrated in FIG. 5. The support member 26 is moved in the +Y direction to thus press both ends of the support shaft 281 inward along the pair of trigger plates 273, and to eventually cause the two pieces of the support shafts 281 to fit into the corresponding fitting holes 271. Then, the support member 26 is attached to the base body 50 such that the pressing is released from the elastic member 282, or the support shaft 281 is moved in a direction in which the pressing is released and the fitting state where the support shaft 281 fits into the bearing 272 is held.

As described above, the printing apparatus 100 includes the printing unit 10 configured to perform printing on the printing medium 1, the driving roller 21 configured to provide a transporting force to the printing medium 1, and the plurality of driven rollers 22 pressed against the printing medium 1 being transported by the driving roller 21 and rotate in conjunction with the movement of the printing medium 1. The printing apparatus 100 also includes the plurality of the support members 26 each supporting the rotation shaft 221 serving as a rotation axis about which each of the plurality of the driven rollers 22 rotates, the base body 50 to which the plurality of the support members 26 are attached, and the attachment/removal mechanism 80 that allows the plurality of the support members 26 to be individually and removably attachable to the base body 50.

Further, the attachment/removal mechanism 80 includes the fitting metal 27 provided at the base body 50, and the support shaft 281 provided at the support member 26 and fitting with the fitting metal 27. The attachment/removal mechanism 80, when the support member 26 is attached to the base body 50, causes the elastic force of the elastic member 282 included in the fitting portion 28 to hold the fitting state where the support shaft 281 fits into the bearing 272.

Such a configuration allows the support member 26 to be pivotally movable in a Y-Z plane about the support shaft 281 extending in the X-axis direction serving as an axis.

The pressing force setting unit 25 is a mechanism configured to set and adjust a pressing force for causing the driven roller 22 to apply the pressing force when the driven roller 22 and the driving roller 21 clamp the printing medium 1 in between with the support shaft 281 acting as a supporting point. The pressing force setting unit 25 is provided at each of the support members 26, as illustrated in FIG. 4.

The pressing force setting unit 25 is constituted by a cam 251 constituting a cam structure, a cam bar 252, a coil spring 254, an adjustment screw 256 for making a length of the coil spring variable, and the like. The pressing force from the driven roller 22 is set depending on a position at which the cam 251 rotates, and the pressing force of the coil spring is adjusted by the length of the coil spring adjusted by the adjustment screw 256.

The cam 251 is pivotally moved in the Y-Z plane by the cam rotation shaft 253 provided across the width direction of the printing medium 1 in parallel to the driving roller 21, where a cam outer circumferential surface 251*a*, which continuously varies in distance from the cam rotation shaft 253, abuts against a lower surface of the cam bar 252. Each of the cams 251 provided at each of the pressing force setting units 25 is attached to the cam rotation shaft 253 so as to rotate in phase with the rotation of the cam rotation shaft 253. The cam rotation shaft 253 is controlled in rotation angle by a cam motor (not illustrated) that is controlled by the control unit 70.

The cam bar 252, which is a structural member configured to pivotally move in the Y-Z plane about the cambar rotation shaft 255 provided at an end portion in the +Y direction of the cam bar 252 serving as an axis, includes an abutment surface 252*a* that abuts against the cam outer circumferential surface 251*a* at an upside of the cam 251. The abutment surface 252*a* is synonymous with the lower surface of the cam bar 252. The cambar rotation shaft 255 are pivotally supported at both ends by the support plate 50*a*. An end portion in the −Y direction of the cam bar 252 is coupled with a one end portion 254*a* of the coil spring 254. The cam bar 252 receives a pressing force from the cam 251 between the cambar rotation shaft 255 and a joining section of the coil spring 254, and is then pivotally moved about the cambar rotation shaft 255 serving as an axis to expand and contract the coil spring 254 jointed to the end portion in the −Y direction of the cam bar 252.

When the driven roller 22 and the driving roller 21 clamp the printing medium 1 in between, the cam bar 252 receives a pressing force from the cam 251 to expand the coil spring 254, to thus generate a pressing force for causing the driven roller 22 supported by a tip portion of the support member 26 to press the printing medium 1 against the driving roller 21 located at the lowerside of the driven roller 22. As such, a biasing force generated when the coil spring 254 is expanded becomes the pressing force from the driven roller 22, thus, the pressing force from the driven roller 22 is strengthened as an expansion length of the coil spring 254 elongates. That is, the cam 251 is pivotally moved to selectively set a position of the one end portion 254*a* of the coil spring 254, and to set a pressing force corresponding to a pivot position of the cam 251.

The pressing force is selected when the control unit 70 controls a pivot angle of the cam rotation shaft 253 to reach a predetermined value depending on the thickness and material of the printing medium 1, and also depending on an operation mode of the printing apparatus 100 such as a transport and release of the printing medium 1.

The adjustment screw 256 is used to adjust the selected one length of the coil spring 254 to thus adjust the pressing force that is set. The adjustment of the pressing force is conducted when the variations in the pressing force between the respective driven rollers 22 are adjusted to be within a predetermined permissible range.

The adjustment end in a +Z direction of the adjustment screw 256 is removably coupled to another end portion 254*b* of the coil spring 254, and can be used to adjust a position of the other end portion 254*b* of the coil spring 254 relative to an end portion in the −Y direction of the support member 26, that is, a length of the coil spring 254.

According to Embodiment 1, the following advantageous effects can be achieved.

The plurality of the support members 26 individually supporting each of the rotation shafts 221 are individually and removably attached to the base body 50 via the attachment/removal mechanism 80, and thus, even when some of the plurality of the support members 26 are damaged, those damaged support members 26 are selectively and readily removable and replaceable.

Also, the configuration is employed in which the elastic force of the elastic member 282 holds the fitting state where the support shaft 281 fits into the bearing 272, and thus the fitting state is maintained, as well as an attachment/removal of the support member 26 is facilitated.

Further, the support member 26 is configured to be supportable by the bearing 272, and to pivotally move about the support shaft 281 as a pivot shaft. In addition, the support shaft 281 is displaceable in the axial direction via the elastic member 282 relative to the support member 26, thus making it possible to readily release the fitting of the support shaft 281 from the bearing 272 having the fitting hole 271 into which the support shaft 281 fits. This allows the support member 26 to be readily removable from the base body 50.

2. Modification Example 1

Figure 6:
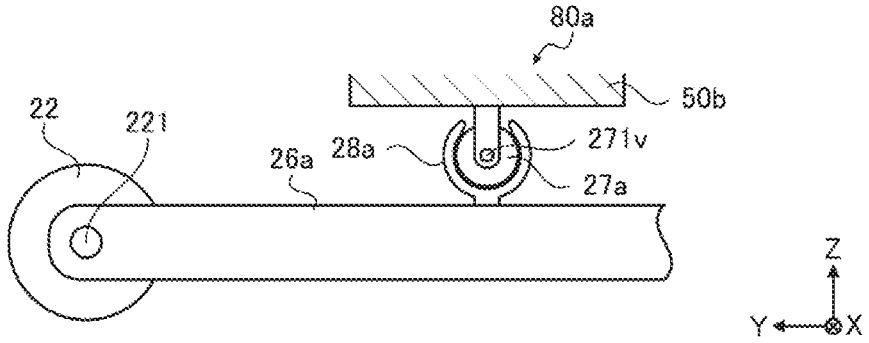
FIG. 6 is a schematic view illustrating a configuration of an attachment/removal mechanism according to Modification Example 1.

FIG. 6 is a schematic view illustrating a configuration of an attachment/removal mechanism 80*a* according to Modification Example 1.

A printing apparatus 100*a* of Modification Example 1 includes the attachment/removal mechanism 80*a* in place of the attachment/removal mechanism 80 in Embodiment 1. The printing apparatus 100*a* of Modification Example 1 also includes a plurality of support members 26*a* as in Embodiment 1.

The attachment/removal mechanism 80*a* is constituted by a pivot shaft member 27*a* as a base portion, and a fitting member 28*a* as a fitting portion fitting around the pivot shaft member 27*a*. That is, the support member 26*a* of Modification Example 1 includes the fitting member 28*a* in place of the fitting portion 28.

The pivot shaft member 27*a*, which is a metal member having a cylindrical shape extending in the X-axis direction, is pivotally supported by the support frame 50*b* about a pivot shaft 271*v* along the X-axis direction serving as an axis center. A length in the X-axis direction of the pivot shaft member 27*a* is approximately equal to the length of the support frame 50*b*, and is constituted by one piece of member, however, the present disclosure is not limited to this. For example, in a manner corresponding to each of the support members 26*a*, the length in the X-axis direction of the pivot shaft member 27*a* may be less than the length of the support frame 50*b*, and a plurality of the pivot shaft members 27*a* may be provided side by side in the X-axis direction. The fitting member 28*a* forms a tubular body composed of a resin extending in the X-axis direction and formed opening at a top portion in the +Z direction of the support member 26*a* in a state where the support member 26*a* is attached to the support frame 50*b*. The fitting member 28*a* is also fixed to an upper portion of a center portion in the longitudinal direction of the support member 26*a*. A width (gap) in the Y-axis direction of an opening formed at the fitting member 28*a* is slightly less than a diameter of the pivot shaft member 27*a*.

The fitting member 28*a* is pressed against the pivot shaft member 27*a* from the lowerside, then, a top portion that is opened of the fitting member 28*a* opens along a side face of the pivot shaft member 27*a* and the pivot shaft member 27*a* fits into the fitting member 28*a*. A side face portion of the fitting member 28*a* clamps the pivot shaft member 27*a* as an elastic member to hold the fitting state.

The support member 26*a*, when attached to the support frame 50*b* by the attachment/removal mechanism 80*a* having such a configuration, comes to be pivotally supported in the Y-Z plane about the pivot shaft 271*v* serving as an axis.

In the printing apparatus 100*a* of Modification Example 1 as well, the configuration is employed in which the plurality of the support members 26*a* individually supporting each of the rotation shafts 221 are individually and removably attachable to the base body 50 via the attachment/removal mechanism 80*a*, and thus, even when some of the plurality of the support members 26*a* are damaged, those damaged support members 26*a* are selectively and readily removable and replaceable.

Figure 7:
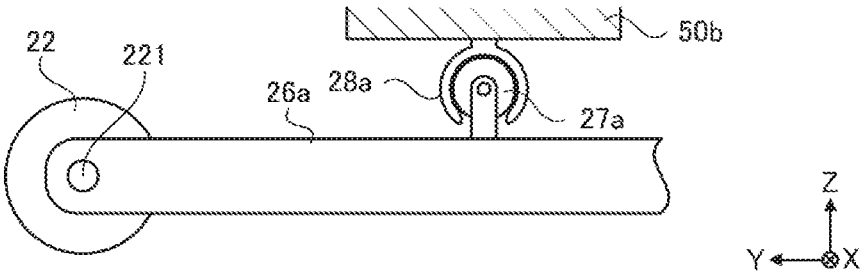
FIG. 7 is a schematic view illustrating another attachment/removal mechanism according to Modification Example 1.

Note that a configuration may be employed in which the pivot shaft member 27*a* and the fitting portion 28 of Modification Example 1 are attached at reverse positions as illustrated in FIG. 7. That is, a configuration may also be employed in which the pivot shaft member 27*a* is provided at the support member 26*a* and the fitting member 28*a* is provided at the support frame 50*b*. However, a configuration is required in which the pivot shaft member 27*a* is independently provided at each of the support members 26*a*.

As such, it suffices that the elastic member that generates the elastic force for holding the fitting state where the fitting portion fits with the base portion be included in one of the base portion or the fitting portion.

3. Modification Example 2

Figure 8:
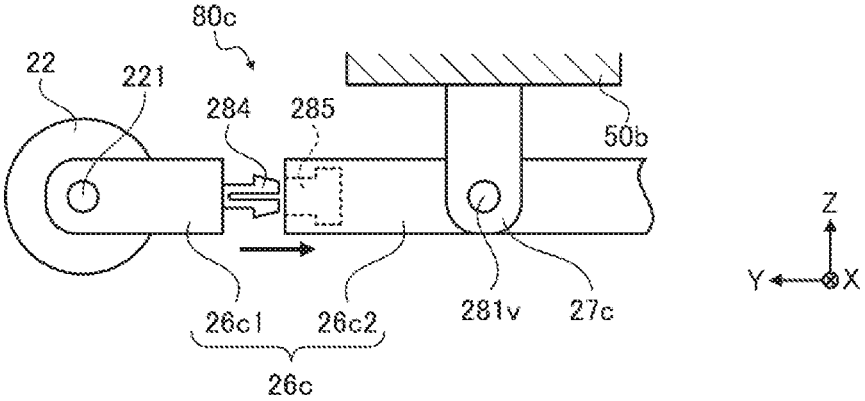
FIG. 8 is a schematic view illustrating an attachment/removal mechanism according to Modification Example 2.

FIG. 8 is a schematic view illustrating an attachment/removal mechanism 80*c* according to Modification Example 2.

A printing apparatus 100*c* of Modification Example 2 includes the attachment/removal mechanism 80*c* in place of the attachment/removal mechanism 80 in Embodiment 1.

Specifically, a support member 26*c* does not include the slit 283 and thus does not include the elastic member 282, and a support shaft 281*c* replacing the support shaft 281 is formed in a manner protruding from a center portion of the support member 26*c* toward an outer side in a width direction of the support member 26*c*. Further, the support shaft 281*c* is pivotally supported via a fitting metal 27*c* by the support frame 50*b*.

In addition, the attachment/removal mechanism 80*c* replacing the attachment/removal mechanism 80 is provided at the support member 26*c*, as illustrated in FIG. 8. The support member 26*c* can be separated into a support member 26*c*1 and a support member 26*c*2 by the attachment/removal mechanism 80*c*. That is, in Embodiment 1, the fitting metal 27 constitutes the base portion, however, in Modification Example 2, the support member 26*c*2 supported via the fitting metal 27*c* by the support frame 50*b* corresponds to the base portion of the present application. Thus, the support member 26*c*1 corresponds to the support member of the present application.

The support member 26*c*1 constitutes a +Y side of the support member 26*c* in a state where the support member 26*c* is attached to the support frame 50*b*, and individually supports the rotation shaft 221 of each of the driven rollers 22 at an end portion in the +Y direction. The support member 26*c*1 includes a fitting portion 284 constituting one of the attachment/removal mechanisms 80*c* at an end portion in the −Y direction.

The support member 26*c*2, which constitutes a −Y side of the support member 26*c* in a state where the support member 26*c* is attached to the support frame 50*b*, includes a fitting hole 285 constituting another one of the attachment/removal mechanism 80*c* at an end portion in the +Y direction, where the pressing force setting unit 25 individually provided for setting the pressing force from the driven roller 22 is coupled to an end portion in the −Y direction. The support member 26*c*also includes the support shaft 281*c* at a side slightly close to the +Y side from a center portion of the support member 26*c*2 in a direction in which the support member 26*c*2 extends. The support member 26*c* is pivotally movable in the Y-Z plane about the support shaft 281*c* serving as an axis.

Note that in FIG. 8, an illustration of the −Y side of the support member 26*c* to which the pressing force setting unit 25 is coupled is omitted.

The fitting portion 284, which is a male fitting member protruding in tuning-fork shape formed of an elastic member, includes a pair of protrusions protruding in a direction intersecting a direction in which the fitting portion 284 protrudes as illustrated in FIG. 8. Specifically, when the direction in which the fitting portion 284 protrudes is made to coincide with the −Y direction, a protrusion extending in the +Z direction and a protrusion extending in the −Z direction are provided at a tip region in the −Y direction of the fitting portion 284.

The fitting hole 285 constituting a female fitting portion includes an inner wall having a shape into/from which the fitting portion 284 having a shape matching with a pair of the protrusions of the fitting portion 284 is insertable/removable. When causing the fitting portion 284 to fit into the fitting hole 285, the protrusions of the fitting portion 284 press the inner wall of the fitting hole 285 to make a fixation by an elastic force, to thus fix the fitting portion 284 to the fitting hole 285. The fitting hole 285 is also formed at a tip region on the +Y side of the support member 26*c*2.

In the printing apparatus 100*c* of Modification Example 2 as well, the configuration is employed in which a plurality of the support members 26*c*1 individually supporting each of the rotation shafts 221 are individually and removably attachable to the base body 50 via the fitting metal 27*c* and the attachment/removal mechanism 80*c* that is removable, and thus, even when some of the plurality of the support members 26*c*1 are damaged, those damaged support members 26*c*1 are selectively and readily removable and replaceable.

Figure 9:
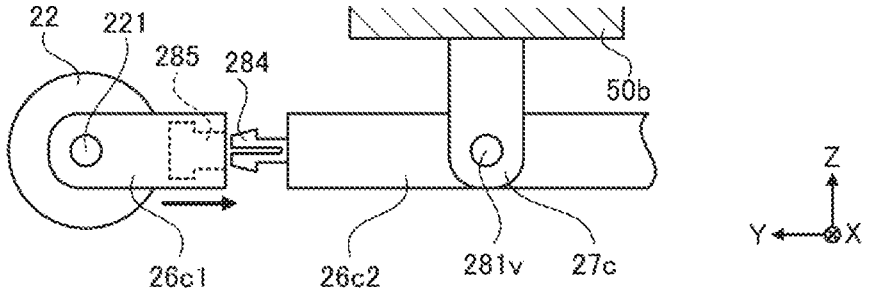
FIG. 9 is a schematic view illustrating another attachment/removal mechanism according to Modification Example 2.

Note that a configuration may also be employed in which the fitting portion 284 and the fitting hole 285 of Modification Example 2 are provided at reverse positions as illustrated in FIG. 9. That is, a configuration may also be employed in which the fitting portion 284 is provided at the support member 26*c*2 and the fitting hole 285 is provided at the support member 26*c*1.

In addition, in a state where the support member 26*c*1 is attached to the support member 26*c*2, the positions at which the fitting portion 284 and the fitting hole 285 are formed may be appropriately subjected to a design change as long as the driven roller 22 can press the printing medium 1 against the driving roller 21. For example, when the fitting portion 284 protrudes in the +Z direction, the fitting hole 285 is formed on a −Z side of the support member 26*c*2.

4. Modification Example 3

Figure 10:
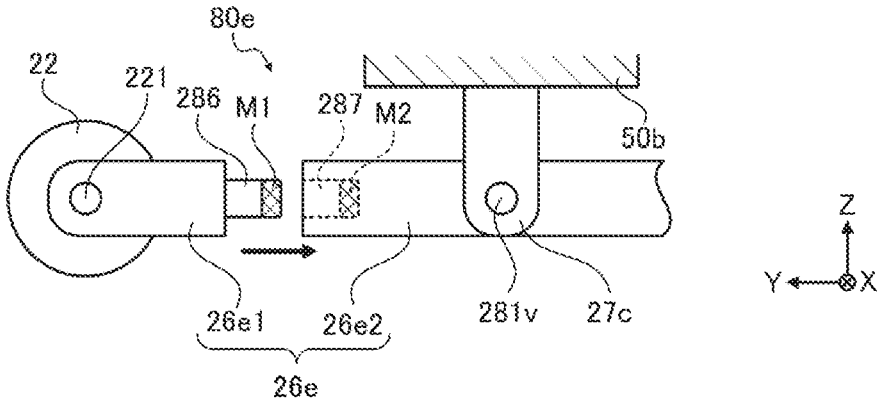
FIG. 10 is a schematic view illustrating an attachment/removal mechanism according to Modification Example 3.

FIG. 10 is a schematic view illustrating an attachment/removal mechanism 80*e* according to Modification Example 3.

A printing apparatus 100*e* of Modification Example 3 includes the attachment/removal mechanism 80*e* in place of the attachment/removal mechanism 80 in Embodiment 1.

A support member 26*e* does not include the slit 283 and thus does not include the elastic member 282, and the support shaft 281*c* replacing the support shaft 281 is formed in a manner protruding from a center portion of the support member 26*e* toward an outer side in a width direction of the support member 26*e*. Further, the support shaft 281*c* is pivotally supported via the fitting metal 27*c* by the support frame 50*b*.

In addition, the attachment/removal mechanism 80*e* replacing the attachment/removal mechanism 80 is provided at the support member 26*e*, as illustrated in FIG. 10. The support member 26*e* can be separated into a support member 26*e*1 and a support member 26*e*2 by the attachment/removal mechanism 80*e*. That is, in Embodiment 1, the fitting metal 27 constitutes the base portion, however, in Modification Example 3, the support member 26*e*2 supported via the fitting metal 27*c* by the support frame 50*b* corresponds to the base portion of the present application. Thus, the support member 26*e*1 corresponds to the support member of the present application.

The support member 26*e*1, which constitutes a +Y side of the support member 26*e* in a state where the support member 26*e* is attached to the support frame 50*b*, individually supports the rotation shaft 221 of each of the driven rollers 22 at an end portion in the +Y direction. The support member 26*e*1 includes a fitting portion 286 constituting one of the attachment/removal mechanisms 80*e* at an end portion in the −Y direction.

The support member 26*e*2, which constitutes a −Y side of the support member 26*e* in a state where he support member 26*e* is attached to the support frame 50*b*, includes a fitting hole 287 constituting another one of the attachment/removal mechanism 80*e* at an end portion in the +Y direction, where the pressing force setting unit 25 individually provided for setting the pressing force from the driven roller 22 is coupled to an end portion in the −Y direction. The support member 26*e*2 also includes the support shaft 281*c* at a side slightly close to the +Y side from a center portion of the support member 26*e*2 in a direction in which the support member 26*e*2 extends. The support member 26*e* is pivotally movable in the Y-Z plane about the support shaft 281*c* serving as an axis.

Note that in FIG. 10, an illustration of the −Y side of the support member 26*e* to which the pressing force setting unit 25 is coupled is omitted.

The fitting portion 286 is a male fitting member, where a magnet M1 is affixed to a tip portion in the −Y direction.

The fitting hole 287 constituting a female fitting portion includes an inner wall having a shape into/from which the fitting portion 286 that conforms the shape of the fitting portion 286 is insertable/removable, where a ferromagnetic body M2 is attached to a rear side in the −Y direction. When causing the fitting portion 286 to fit into the fitting hole 287, a magnetic force occurring between the magnet M1 of the fitting portion 286 and the ferromagnetic body M2 of the fitting hole 287 holds a fitting state between the fitting portion 286 and the fitting hole 287.

In the printing apparatus 100*e* of Modification Example 3 as well, the configuration is employed in which the plurality of the support members 26*e*1 individually supporting each of the rotation shafts 221 are individually and removably attachable to the base body 50 via the fitting metal 27*c* and the attachment/removal mechanism 80*e* that is removable, and thus, even when some of the plurality of the support members 26*e*1 are damaged, those damaged support members 26*e*1 are selectively and readily removable and replaceable.

Note that a configuration may also be employed in which the magnet M1 and the ferromagnetic body M2 are mutually provided at reverse positions. In addition, as long as a configuration is employed in which when the magnet M1 and the ferromagnetic body M2 are attracted to each other by a magnetic force, the ferromagnetic body M2 may be a magnet.

5. Modification Example 4

Figure 11:
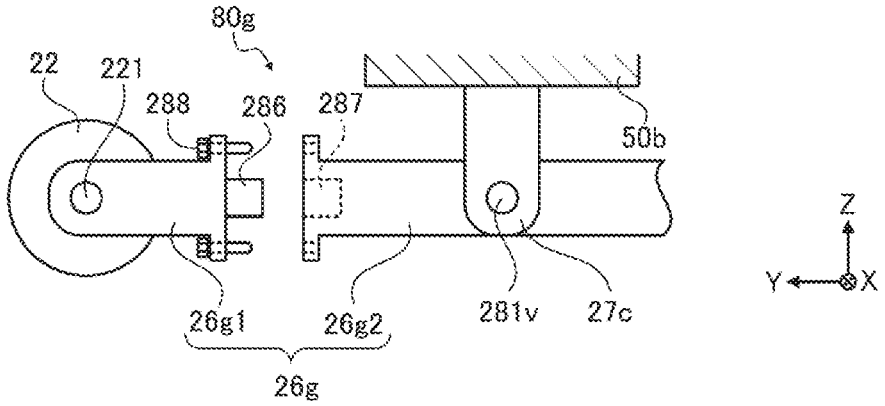
FIG. 11 is a schematic view illustrating an attachment/removal mechanism according to Modification Example 4.

FIG. 11 is a schematic view illustrating an attachment/removal mechanism 80*g* according to Modification Example 4.

A printing apparatus 100*g* of Modification Example 4 includes the attachment/removal mechanism 80*g* in place of the attachment/removal mechanism 80 in Embodiment 1.

Specifically, a support member 26*g* does not include the slit 283 and thus does not include the elastic member 282, and the support shaft 281*c* replacing the support shaft 281 is formed in a manner protruding from a center portion of the support member 26*g* toward an outer side in a width direction of the support member 26*g*. Further, the support shaft 281*c* is pivotally supported via the fitting metal 27*c* by the support frame 50*b*.

In addition, the attachment/removal mechanism 80*g* replacing the attachment/removal mechanism 80 is provided at the support member 26*g*, as illustrated in FIG. 11, The support member 26*g* can be separated into a support member 26*g*1 and a support member 26*g*2 by the attachment/removal mechanism 80*g*. That is, in Embodiment 1, the fitting metal 27 constitutes the base portion, however, in Modification Example 4, the support member 26*g*2 supported via the fitting metal 27*c* by the support frame 50*b* corresponds to the base portion of the present application. Thus, the support member 26*g*1 corresponds to the support member of the present application.

The attachment/removal mechanism 80*g* is constituted by the fitting portion 286 for causing the support member 26*g*1 to fit with the support member 26*g*2, the fitting hole 287, a screw 288 for holding the fitting state, and the like. Further, as illustrated in FIG. 11, the support member 26*g*1 and the support member 26*g*2 are each provided with a flange for jointing by the screw 288 at a joint surface to which each of the members is jointed.

Note that in order to facilitate an attachment/removal of the screw 288, it is desirable for the screws 288 to have an attachment position and angle that are suitable according to the configuration surrounding the screws 288.

The plurality of the support members 26*g*1 individually supporting each of the rotation shafts 221 are individually and removably attached to the base body 50 via the fitting metal 27*c* and the attachment/removal mechanism 80*g* that is removable, and thus, even when some of the plurality of the support members 26*g*1 are damaged, those damaged support members 26*g*1 are selectively and readily removable and replaceable.

6. Other Modification Examples

Figure 12:
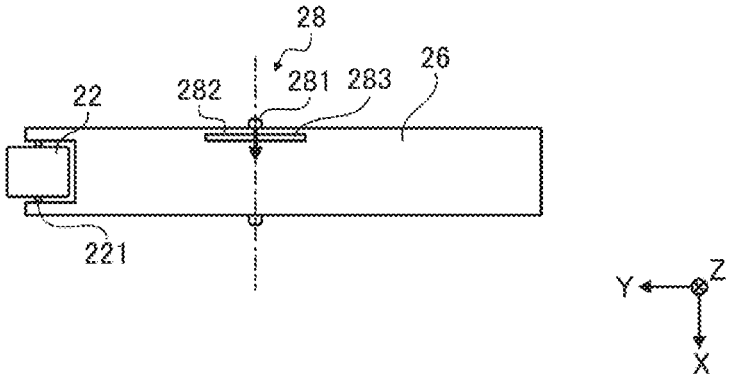
FIG. 12 is a plan view illustrating a configuration of an attachment/removal mechanism of another Modification Example.

In Embodiment 1, the support member 26 is described as including the pair of the support shafts 281 and the pair of elastic members 282 for supporting the support shafts 281, respectively, and a configuration may be employed in which any one of the pair of support shafts 281 is provided with the elastic member 282, as illustrated in FIG. 12.

Also, in Embodiment 1, the configuration is employed in which the one piece of the driven roller 22 is supported by the one piece of the support member 26, and, for example, a configuration may also be employed in which one piece of the rotation shaft 221 is provided with two or more pieces of the driven rollers 22, where the two or more pieces of the driven rollers 22 are supported by the one piece of the support member 26, as illustrated in FIG. 5.

Figure 13:
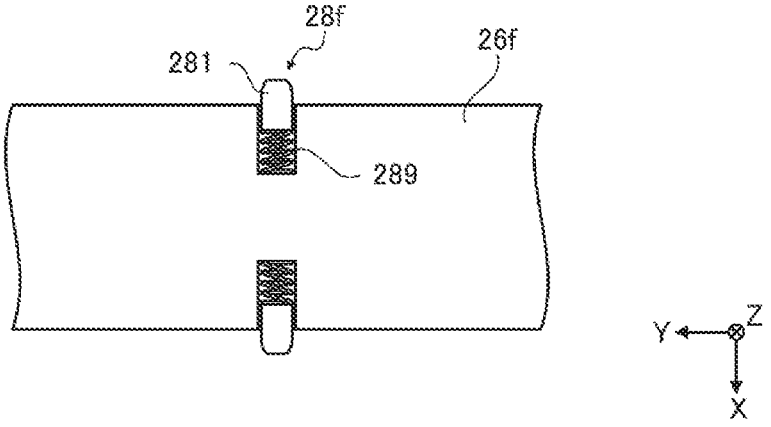
FIG. 13 is a plan view illustrating a configuration of a support shaft of another Modification Example.

Further, in Embodiment 1, the description is given such that the support shaft 281 is supported by the elastic member 282 having a beam-like shape that is integrally molded with the support shaft 281, and a configuration may also be employed in which the support shaft 281 is supported by a spring 289 as an elastic member embedded in a support member 26*f*, as illustrated in FIG. 13.

In addition, in Embodiment 1, the support member 26 is described as being pivotally movable in the Y-Z plane about the support shaft 281 extending in the X-axis direction serving as an axis, however, a configuration may also be employed which is not necessarily such a configuration in which the support member is swingable. For example, a configuration may also be employed in which a support member is vertically movable relative to the printing medium 1 via an elastic member such as a spring or the like between the support member and the support frame 50*b*.

Further, in Embodiment 1, the description is given such that the driven roller 22 is supported by the plurality of the support members 26 so as to clamp the printing medium 1 between the driven roller 22 and the driving roller 21, as illustrated in FIG. 4, however, the driven roller 22 is not limited to be used in the configuration in which the driven roller 22 is paired with the driving roller 21. For example, a configuration may also be employed in which the printing medium 1 is clamped between the driven roller 22 and the platen 61 to suppress a floating of the printing medium 1, a configuration may also be employed in which the printing medium 1 is singly used to constitute a transport path of the printing medium 1, and a configuration may further be employed in which the printing medium 1 is clamped between the driven roller 22 and another driven roller.

Contents derived from the Embodiments will be described below.

A printing apparatus of the present application includes a printing unit configured to perform printing on a printing medium, a driving roller configured to provide a transporting force to the printing medium, a plurality of driven rollers configured to press the printing medium, which is transported by the driving roller, and configured to rotate in conjunction with a movement of the printing medium, a plurality of support members each being configured to support a roller shaft serving as a rotation axis about which each of the plurality of driven rollers rotates, a base body to which the plurality of support members are attached, and an attachment/removal mechanism configured to cause the plurality of support members to be removably attachable individually to the base body.

According to the above configuration, the plurality of support members individually supporting each of the roller shafts are individually and removably attached to the base body via the attachment/removal mechanism, and thus, even when some of the plurality of support members are damaged, those damaged support members are selectively and readily removable and replaceable.

In the printing apparatus described above, the attachment/removal mechanism may include a base portion provided at the base body, and a fitting portion provided at the support member and configured to fit with the base portion, and a fitting state where the fitting portion fits with the base portion, is maintained by an elastic force of an elastic member included in one of the base portion and the fitting portion.

According to the above configuration, a configuration is employed in which the elastic force of the elastic member holds the fitting state where the fitting portion fits with the base portion, and thus, the fitting state is maintained, as well as an attachment/removal of the support member is facilitated.

In the printing apparatus described above, the attachment/removal mechanism may include a base portion provided at the base body, and a fitting portion provided at the support member and configured to fit with the base portion, and when the support member is attached to the base body, and a fitting state where the fitting portion fits with the base portion, is maintained by a magnetic force of a magnet of at least one of the base portion and the fitting portion.

According to the above configuration, a configuration is employed in which the magnetic force of the magnet holds the fitting state where the fitting portion fits with the base portion, and thus, the fitting state is maintained, as well as an attachment/removal of the support member is facilitated.

In the printing apparatus described above, the attachment/removal mechanism may include, a support shaft protruding in an axial direction of the roller shaft as the fitting portion and a bearing having a fitting hole into which the support shaft fits as the base portion, in which the support shaft may be provided to be displaceable relative to the support member via the elastic member in the axial direction.

According to the above configuration, the support member is supported by the bearing as the base body, and is configured to be pivotally movable about the support shaft being the fitting portion serving as a pivot axis. In addition, the support shaft is displaceable in the axial direction via the elastic member relative to the support member, thus making it possible to readily release the fitting of the support shaft from the bearing having the fitting hole into which the support shaft fits. This allows the support member to be readily removable from the base body.

What is claimed is:

1. A printing apparatus, comprising:

a printing unit configured to perform printing onto a printing medium;

a driving roller configured to provide a transporting force to the printing medium;

a plurality of driven rollers configured to press the printing medium, which is transported by the driving roller, and configured to rotate in conjunction with a movement of the printing medium;

a plurality of support members each being configured to support a roller shaft serving as a rotation axis about which each of the plurality of driven rollers rotates;

a base body to which the plurality of support members are attached; and an attachment/removal mechanism configured to cause the plurality of support members to be removably attachable individually to the base body.

2. The printing apparatus according to claim 1, wherein the attachment/removal mechanism includes a base portion provided at the base body, and a fitting portion provided at the support member and configured to fit with the base portion, and a fitting state where the fitting portion fits with the base portion, is maintained by an elastic force of an elastic member included in one of the base portion and the fitting portion.

3. The printing apparatus according to claim 1, wherein the attachment/removal mechanism includes a base portion provided at the base body, and a fitting portion provided at the support member and configured to fit with the base portion, and a fitting state where the fitting portion fits with the base portion, is maintained by a magnetic force of a magnet of at least one of the base portion and the fitting portion.

4. The printing apparatus according to claim 2, wherein the attachment/removal mechanism includes:

a support shaft protruding in an axial direction of the roller shaft as the fitting portion; and a bearing having a fitting hole into which the support shaft fits as the base portion, wherein the support shaft is provided to be displaceable relative to the support member via the elastic member in the axial direction.

* * * * *